United States Patent [19]

Pfister et al.

[11] Patent Number: 4,718,161

[45] Date of Patent: Jan. 12, 1988

[54] PRESS TOOL COMPRISING INTERCHANGEABLE WORKING PARTS

[75] Inventors: Jean M. Pfister; Dorice Vrignaud, both of La Roche Sur Yon, France

[73] Assignee: Essweing S.A., Sur Yon, France

[21] Appl. No.: 857,368

[22] Filed: Apr. 30, 1986

[30] Foreign Application Priority Data

Apr. 30, 1985 [FR] France ..... 85 06571

[51] Int. Cl.[4] ..... B23Q 3/00

[52] U.S. Cl. ..... 29/568; 83/138; 83/685; 83/699

[58] Field of Search ..... 83/698, 699, 700, 138, 83/685; 100/918; 29/568; 72/481, 470

[56] References Cited

U.S. PATENT DOCUMENTS 2,364,401 12/1944 Stellin ..... 83/698 X
2,387,027 10/1945 Jackson ..... 83/698 X
3,327,575 6/1967 Duffer et al. ..... 83/698 X
3,429,212 2/1969 Weisbeck ..... 83/698 X
4,171,656 10/1979 Gargrave ..... 83/698
4,624,165 11/1986 Bredow et al. ..... 83/698 X

*Primary Examiner*—Frank T. Yost
*Attorney, Agent, or Firm*—Cushman, Darby & Cushman

[57] ABSTRACT

A press tool having working parts constituted by stamps and dies and attachment parts such as blank-holders, punch-holders, die-holders, and stay blocks of the tool, wherein interchangeable stamps and dies, formed from metallic removable disc like elements are held by detachable die or stamp-holders, and cradles. The cradles are intended to receive and maintain in place the die or stamp-holder, and are provided with at least one recess presenting a form complementary to that of the holders for each of the die or stamp-holders, an adjustable clamp system is provided which cooperates with an associated cradle in order to render the holder radially and axially immovable.

8 Claims, 4 Drawing Figures

PRESS TOOL COMPRISING INTERCHANGEABLE WORKING PARTS

BACKGROUND OF THE INVENTION

1. Field of the Invention

The present invention concerns a press tool comprising interchangeable working parts.

For the manufacture of metal or sheet metal pieces, tools that are normally mounted upon a press or stamping machine are utilized to carry out punching, swaging, cambering, bending and similar operations. These tools generally comprise working parts constituted by stamps and dies that are subject to more or less rapid wear, attachment parts such as, punch-holders and die-holders, stay blocks that are respectively mounted on the slide and press table, and a blank-holder normally intended for solidly maintaining in place a metal sheet subject to a shape-forming operation of the tool and for guiding these stamps during sliding.

According to known techniques, each press tool is designed so as to correspond to a given piece to be manufactured having preestablished dimensions and shape. When using such tools, any modification of the shape or type of piece to be manufactured normally requires a complete change of the tool on the assembly including all working parts. For this reason the working parts of known tools, i.e. the stamps, dies, and their attachment parts, are generally conceived or disposed fixed in order to obtain an essentially solid mechanical assembly rather than a rapidly mounted or dismantled assembly of these tools or their stamps and dies. This means that in said known tools, servicing, adjustment or replacement of a die or a stamp often requires a relatively long assembly or dismantling operation time.

2. Brief Summary of the Invention

The object of the present invention is to overcome these drawbacks by providing a press tool in which the working parts are interchangeable, easily mounted, dismantled and adjusted, solidly maintained in place and requiring a relatively short time for mounting and dismantling for their servicing, adjustment, replacement or substitution.

According to the present invention, a press tool having working parts constituted by stamps and dies and attachment parts such as blank-holders, punch-holders and die-holders, and stay blocks of the tool, comprise, as working parts, interchangeable stamps and dies produced respectively from metallic pieces or removable disc like elements. Attachment parts, comprising detachable blank-holders and stamp-holders, and cradles, (intended to receive and maintain in place blank-holders and stamp-holders) and other attachment parts for the cradle, each provided with at least one recess presenting a form complementary to that of the supporting cradles. These other attachment parts are intended to receive and secure in rotation and translation one of the cradles, and, for each blank-holder and stamp-holder, an adjustable clamp system cooperating with its cradle in order to secure it radially and axially.

BRIEF DESCRIPTION OF THE DRAWINGS

The present invention will become clearly apparent from the following description of various embodiments, given by way of non-limitative illustration and referring to the appended drawings in which.

DETAILED DESCRIPTION OF THE PREFERRED EMBODIMENT

Figure 1:
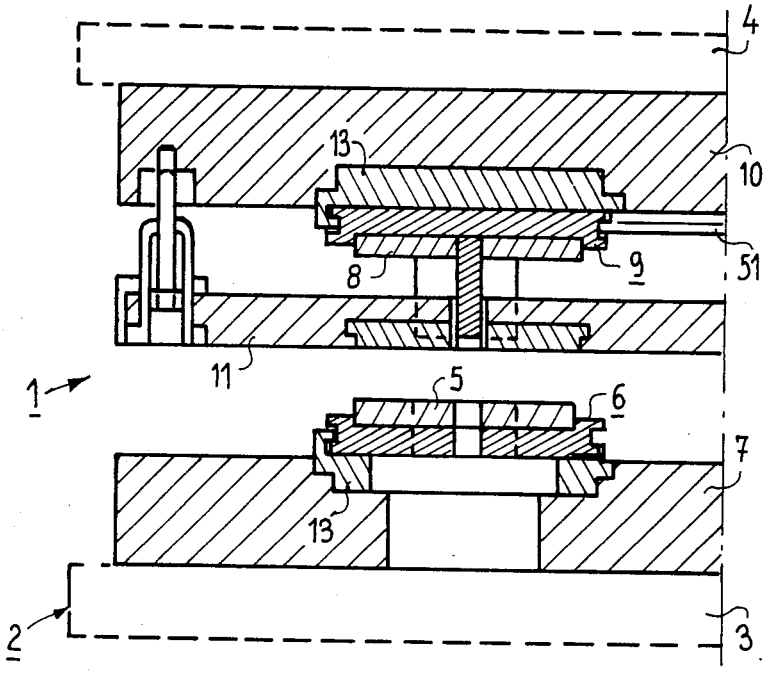
FIG. 1 represents an incomplete schematic view in cross-section of a portion of a part of a tool produced according to the invention, mounted on a press.

The present invention applies to all types of press tools including picking-up tools and following-up tools. The term "picking-up tool" normally designates a press tool that operates only once on a metal sheet so as to confer thereupon a more or less complex form. The term of "following-up tool" generally designates a tool comprising a plurality of aligned working stations, disposed one after the other, upon which is caused to stepwise follow-up, at a determined rate, a metal or sheet metal strip in order to carry out on this strip at each of these working stations, a preestablished operation such as punching, swaging, bending, stamping, etc., and to obtain at the exit from the last one of said working stations a finished piece severed from said metal or sheet metal strip and presenting a more or less complex form.

A press tool 1, according to an embodiment of the invention, as schematically illustrated in FIGS. 1 to 4 is intended to be mounted upon a press or a stamping machine 2, the table 3 and the slide 4 which are schematically represented in broken lines.

The press tool 1 comprises firstly at least one die 5, a die-holder 6 and a lower stay block 7 that is mounted on the table 3 of the press 2; secondly, a stamp 8, a stamp-holder 9 and an upper stay block 10 that is mounted on the slide 4 of the press 2, and thirdly a blank-holder 11 disposed between this die 5 and this stamp 8.

The working parts of the tool 1 are the die(s) 5 and the stamp(s) 8 and the attachment parts of the tool 1 are the stamp-holder(s) 6, the lower stay block 7, the stamp-holder 9 and the upper stay block 10. In tool 1, the attachment parts 6–7 of the die 5 and the attachment parts 9–10 of the stamp 8 have according to the invention an analog structure. For enhanced simplicity in presenting the invention, the following description is given with reference to a die 5, but it is equally applicable to an assembly relating to a stamp 8 or a blank-holder 11.

According to one main characteristic of the invention, the press tool 1 comprises as working parts interchangeable dies 5 and stamps 8 produced respectively from detachable metallic pieces or disc like elements and, as attachment parts, detachable die-holder 6 and stamp-holder 9, and cradles 13 intended to receive and maintain in place die-holder 6 and stamp-holder 9, and further, two stay blocks 7, 10 of the tool, each provided with at least one housing or recess 14 presenting a form complementary to that of cradles 13 to receive and secure in rotation and in translation one of these cradles 13, and, for each die-holder and stamp-holder, an adjustable clamp system 20 cooperating with its cradle 13 in order to secure it radially and axially.

Figure 2:
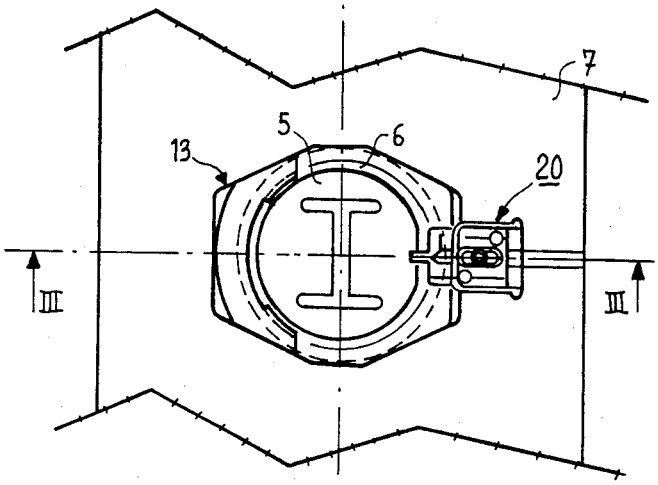
FIG. 2 represents on a different scale an incomplete schematic view from above of a die and its die-holder of the tool of FIG. 1.
Figure 4:
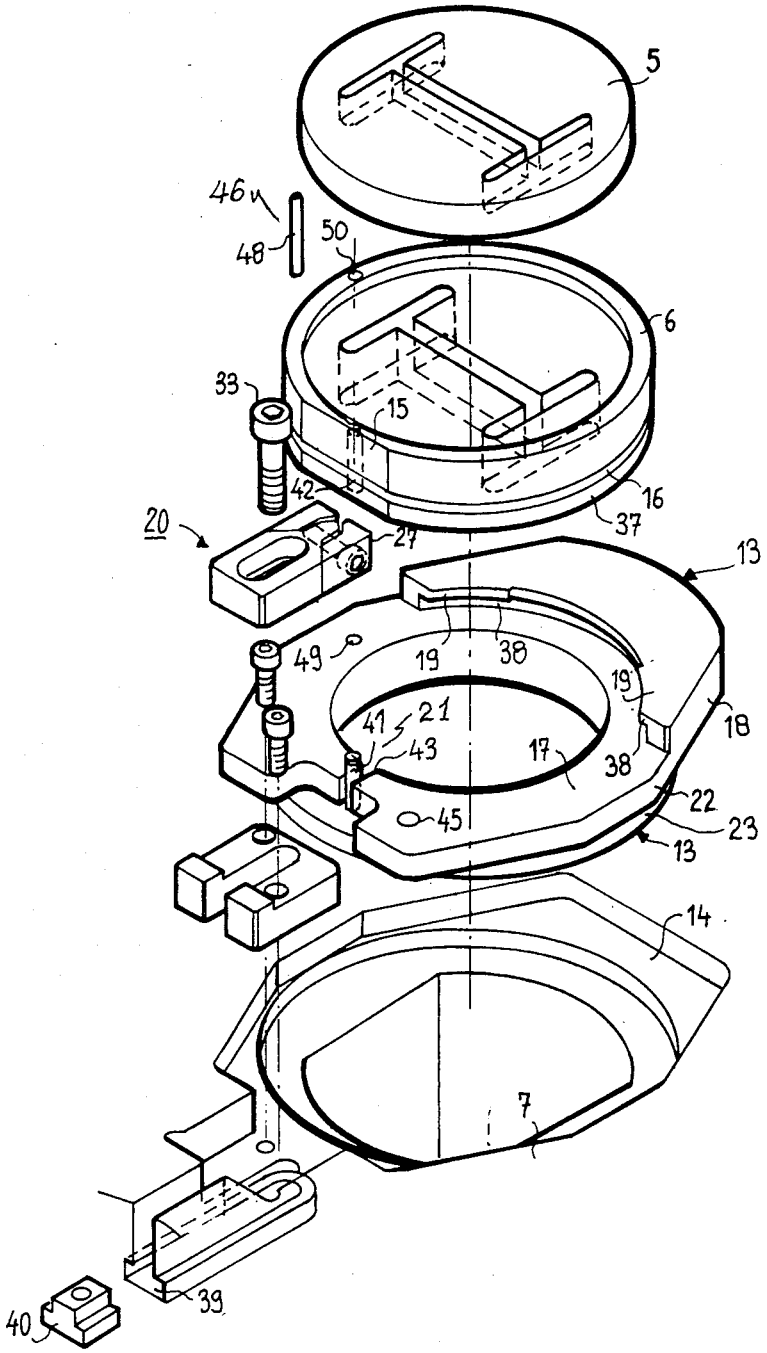
FIG. 4 represents on another scale, an exploded view of a portion of the die, of a die-holder, of a cradle and of a stay block of the tool illustrated in FIG. 2.

According to another characteristic of the press tool 1, a detachable die-holder 6 or stamp-holder 9 is constituted by a metallic piece with recess, for receiving the working part 5 or 8, and having a cylindrical external lateral surface provided with a flattened part 15 with annular retaining means 16. The associated cradle 13 having the form of a crown with a plane surface 17 having, on a portion of the periphery of this surface, an axial edge 18 having, in its internal lateral wall, retaining means 19 in the form of an arc of a circle. Circular retaining means 19 cooperates with the adjustable clamp system 20, the flattened part 15, and the annular retaining means 16 (of the die-holder 6 or the stamp-holder 9) in order to constitute a system having at least two opposite facing abutment zones for rendering radially and axially immovable the die-holder 6 or the stamp-holder 9 on the plane surface 17 of cradle 13. This system has two diametrically opposed bearing or abutment zones 15–19 when the arc of a circle means or circular retaining means 19 form a single unit 19 (not represented). This system has three opposed bearing zones angularly spaced apart from one another 19-15-19, when the circular retaining means 19 are split into two and spaced apart, as shown in FIGS. 2 and 4, by an angle alpha of about 30° to 180°.

According to another characteristic, the press tool 1 is provided with a system 21 for angularly positioning a die 5 and die-holder assembly 6 or a stamp 8 and stamp-holder 9 assembly in the tool. This system 21 comprises two elements that can be assembled together using either a pin or a rod and a groove adjusted to this pin in order to receive it, without clearance. One of the elements being formed in the die and die-holder assembly or stamp and stamp-holder assembly and the other in the corresponding cradle 13.

According to the example illustrated in FIGS. 1, 2, 3 and 4 in the press tool 1, the die 5 is produced as a single cylindrical metallic piece or disc like element. The die 5 is maintained in the cylindrical recess of the die-holder 6. The die-holder 6 is in turn rendered immovable or secured on the stay block 7 by means of a cradle 13. This cradle 13 has the form of a crown presenting a polygonal outline, for example an octogonal outline 22 in its upper part and a circular outline 23 in its lower part.

Die-holder 6 is constituted by a cylindrical piece with its lower portion cut away in order to form a concentric recess having a flat bottom. The cylindrical external wall of the die-holder 6 is provided with a flattened part 15 and a circular or annular groove or channel acting as annular retaining means 16, the bottom and the internal edge of which constitute respectively a radial abutment and an axial retaining shoulder, with respect to the arc of a circle or circular retaining means 19 of the cradle 13. The flattened part 15 acts as a bearing or abutment zone for the frontal part 27 of the adjustable clamp 20 and on the one hand withstands part of a radial or horizontal thrust of this clamp 20 and on the other hand withstands a downward vertical thrust exerted by the said clamp 20. The flattened part 15 of the die-holder 6 and the frontal portion 27 of the rod 20 can have an inclined position. The cradle 13, in the form of a crown, comprises circular retaining means 19, heels or ribs in an arc of a circle, spaced apart from one another having a form complementary to that of the annular groove or channel 16 of the die-holder 6 formed on the internal lateral wall of the axial edge 18. When the die-holder 6 is placed in position and the adjustable clamp 20 is tightened by means of an attachment screw 33, the radial thrust exerted by the rod 20 on the die-holder is withstood by the heels or ribs 19 of the cradle 13 that penetrate the annular groove or channel 16 of die-holder 6 (FIGS. 1 and 3) and bear upon the bottom of the groove. The lower protruding part 37 of the external wall of the die-holder 6 is limited by the annular groove 16 to sliding adjustment, i.e. in adjustment without clearance, in the spaces 38 of the cradle 13 defined on the lower side by the plane surface 17 of the cradle 13 and on the upper side by the lower surface of the heels 19 of the axial edge 18 of cradle 13. The die-holder 6 is thus solidly blocked in the cradle 17 on one side by the heels in the arc of a circle 19 and the plane surface 17 of this cradle, and on the opposite side by the adjustable clamp 20 exerting a radial thrust and a downward vertical thrust, on this die-holder 6, and by this plane surface 17 of this cradle 13.

With respect to the angular positioning of the die 5 and die-holder 6 assembly relative to the cradle 13 and consequently to the stay block 7 of the tool, this positioning is ensured in a precise manner by a pin and groove system 21.

Figure 3:
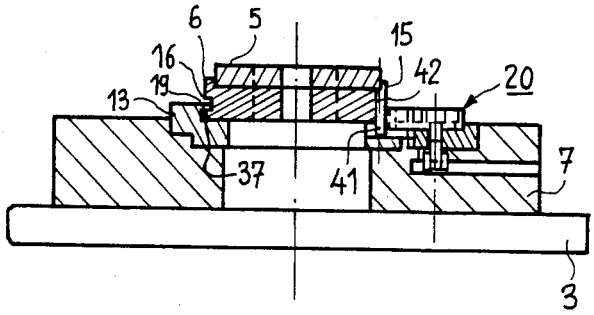
FIG. 3 represents an incomplete schematic view of a cross-section according to III—III, of the die and it die-holder of the tool illustrated in FIG. 2.

In the example illustrated in FIGS. 2, 3 and 4, the pin and groove system 21 comprises, on the one hand, a rod or pin 41 fixed in a hole 42 of the die-holder 6 and, on the other hand, a groove 43 adjusted to this rod or pin 41, formed in the cradle 13.

During mounting of a die 5 and die-holder 6 assembly, the pin or rod 41 carried by this die-holder 6 is engaged without clearance in the groove 43 of the cradle 13 and thus determines a precise orientation or positioning of the die 5 in the tool. In another embodiment according to the invention (not represented), the pin or rod 41 is fixed in the cradle 13 while a groove 43 adjusted to this pin or rod 41 is formed in the die-holder 6.

According to another characteristic, the press tool 1 comprises means 46 for controlling the position of mounting a die 5 and die-holder 6 assembly or a stamp 8 and stamp-holder assembly 9 with respect to a predetermined attachment position for the assembly in the tool. These control means 46 comprise at least, on the one hand, a calibrated diameter pin or rod 48 and on the other hand two calibrated holes having the same diameter as that of this rod 48, one 49 formed at a predetermined place of the cradle 13 and the other 50 at a place in the die-holder 6 or the stamp-holder 9 in such a manner that when this die-holder 6 or this stamp-holder 9 occupies exactly the same predetermined attachment position for which it is intended in the tool 1, this calibrated hole is exactly in alignment with the calibrated hole 49 of the cradle 13 and during a position control, the rod or pin having a calibrated diameter 48 can be temporarily sheathed or slid in these two holes 49 and 50 in alignment. These position control means 46 and the angular positioning system 21 allow a correct mounting of the die 5 and die-holder 6 assembly and the stamp 8 and stamp-holder 9 assembly in the tool 1.

In the tool 1, the die 5 is mounted in the die-holder 6 according to a controlled predetermined position, either by a controlled system with calibrated aligned holes, not represented, formed in the die 5 and the die-holder 6 and with calibrated rod for temporary engagement analog to control means 46, either by a known system of aligned holes (not represented) formed in the die 5 and the die-holder 6 and with a pin mounted in these aligned holes. The die 5 is furthermore fixed in a manner known per se in the die-holder 6 by screws (not represented).

According to another characteristic, the press tool 1 comprises at least in its upper stay block 10, on the two lateral sides of a cradle 13, a system of parallel rails 51 adapted to receive a stamp 8 and stamp-holder 9 assembly and to facilitate a transfer by sliding of this assembly on these rails, from a place outside the tool up to a predetermined position for the attachment of this latter in this cradle 13. The rails of this system 51, can be, during the sliding of a stamp 8 and stamp-holder 9 assembly, either engaged in the annular groove 16 of this assembly in order to support it, or in position so as to form a surface for sliding the assembly.

The rails system 51 facilitates the positioning in place and the attachment of this stamp 8 and stamp-holder 9 assembly in the tool 1. Such a rails assembly 51 can also be mounted on the lower stay block 7 of the tool 1 in order to render more simple the placing in position and the attachment of die 5 and die-stamp 6 assembly.

According to such a structure, a replacement of a die 5 by another interchangeable die or a stamp by another stamp, which can be carried out by simple dismantling and mounting of the die-holder 6 or of the stamp-holder 9, thereby rendering easy the servicing of the tool 1 and reducing the preparation time of the tool in a change of type or model of the piece to be manufactured.

According to one embodiment of the invention (not represented), a die-holder 6 or a stamp-holder 9, comprises, an annular retaining means, a heel or annular rib instead of an annular groove 16, and a cradle analog to cradle 13 having, in the internal lateral wall of its axial edge, as a circular retaining means 19, a circular groove having a form complementary to the annular heel of this die-holder or stamp-holder.

We claim:

1. Working parts for a press constituted by stamps and dies, and attachment parts such as blank-holders, punch-holders, die-holders, and stay blocks, wherein it comprises as working parts;

stamps and dies formed from metallic removable disc like elements; and first attachment means for attaching said stamps and dies to said press including detachable holders, and cradles, said cradles receiving and maintaining in place said holders; and, second attachment means for attaching said cradles to said press said second attachment means having at least one recess presenting a form complementary to that of said cradle, said second attachment means receiving and securing in rotation and in translation one of the corresponding cradles; and, an adjustable clamp system cooperating with a given one of said cradles to render it radially and axially immovable.

2. A press according to claim 1, wherein, said holders each comprise a metallic piece having a recess for receiving a working part, said die or stamp-holders each having a cylindrical external lateral surface with a flattened part and annular retaining means, and wherein, each cradle has the form of a crown with a planar surface provided on one part of the periphery of the crown, with an axial edge of said crown having an internal lateral wall provided with retaining means in the form of an arc of a circle.

3. A press according to claim 2, wherein, said holder annular retaining means is in the form of an arc of a circle, which corresponds to and cooperates with the internal lateral wall of the axial edge of the cradle; and wherein, said adjustable clamp system pushes against the flattened part of said holder towards the annular retaining means of said holder thereby constituting a system having at least two opposed bearing or abutment zones against the surrounding cradle to render the holder axially and radially immovable.

4. A press according to claim 2, wherein, the annular retaining means comprises an annular groove formed in the peripheral external lateral surface of the die or stamp holder and, in the cradle, the circular retaining means comprising a heel or rib in the form of an arc having a shape complementary to said annular groove of said holder.

5. A press according to claim 2, wherein, said annular retaining means comprises an annular heel or rib formed in the peripheral external lateral surface of said holder and, in the cradle, the circular retaining means comprising a circular groove having a form complementary to said annular heel or rib of said holder.

6. A press according to claim 1, wherein, for positioning the die or the stamp in a holder, two elements are provided comprising;

a pin and a groove sized to receive said pin without clearance, one of these elements being connected to the holder and the other of these elements being connected to the cradle.

7. A press according to claim 1, further comprising, alignment means for controlling the mounting position of a holder assembly with respect to a predetermined attachment position for this assembly in the tool, said alignment means comprising;

a rod having a calibrated diameter and two calibrated holes having the same diameter as said rod, one of said calibrated holes formed at a predetermined place in the cradle and the other of said calibrated holes formed at a place in the holder, so that, when the holder occupies exactly the predetermined attachment position which is desired in the tool, the two calibrated holes are exactly aligned and allow a control of position such that an ensheathing or sliding of the rod can occur in the calibrated holes.

8. A press according to claim 1 further comprising;

transport means for facilitating the placing in position of a holder assembly, said transport means comprising a system of parallel rails adapted to receive and transport holder assemblies and to facilitate a transfer by sliding of these assemblies on these rails, from a place outside the tool up to a predetermined position for securing said holder assemblies in the cradle.

* * * * *